US008054285B2

(12) United States Patent
Hasegawa

(10) Patent No.: US 8,054,285 B2
(45) Date of Patent: Nov. 8, 2011

(54) LIQUID CRYSTAL DISPLAY APPARATUS AND LIQUID CRYSTAL TELEVISION, WHICH CAN IMPROVE CONTRAST

(75) Inventor: Hiroyuki Hasegawa, Osaka (JP)

(73) Assignee: Funai Electric Co., Ltd., Daito-shi, Osaka (JP)

( * ) Notice: Subject to any disclaimer, the term of this patent is extended or adjusted under 35 U.S.C. 154(b) by 825 days.

(21) Appl. No.: 12/152,079

(22) Filed: May 12, 2008

(65) Prior Publication Data

US 2008/0284721 A1 Nov. 20, 2008

(30) Foreign Application Priority Data

May 15, 2007 (JP) ..... 2007-129016

(51) Int. Cl.
*G09G 3/36* (2006.01)

(52) U.S. Cl. ..... 345/102; 345/89

(58) Field of Classification Search ..... 345/102, 345/89, 690

See application file for complete search history.

(56) References Cited

U.S. PATENT DOCUMENTS

| | | | | |
|---|---|---|---|---|
| 4,752,771 | A | 6/1988 | Katogi et al. | |
| 5,057,744 | A | 10/1991 | Barbier et al. | |
| 5,717,422 | A | 2/1998 | Fergason | |
| 6,300,931 | B1 | 10/2001 | Someya et al. | |
| 6,762,742 | B2 * | 7/2004 | Moon et al. | 345/102 |
| 2001/0033260 | A1 | 10/2001 | Nishitani et al. | |
| 2004/0113906 | A1 * | 6/2004 | Lew et al. | 345/211 |
| 2004/0257318 | A1 * | 12/2004 | Itoh | 345/87 |
| 2005/0140639 | A1 * | 6/2005 | Oh et al. | 345/102 |
| 2006/0022899 | A1 * | 2/2006 | Johnson | 345/55 |
| 2007/0126757 | A1 * | 6/2007 | Itoh et al. | 345/690 |

FOREIGN PATENT DOCUMENTS

| | | | |
|---|---|---|---|
| EP | 1223570 A | | 7/2002 |
| JP | 06-006820 | | 1/1994 |
| JP | 06006820 A | * | 1/1994 |
| JP | H06-006820 A | | 1/1994 |
| JP | 11-234539 | | 8/1999 |
| JP | 2003-066929 | | 3/2003 |

OTHER PUBLICATIONS

The extended European search report, pursuant to Rule 62 EPC dated Sep. 3, 2008, searched on Aug. 28, 2008.

* cited by examiner

*Primary Examiner* — Chanh Nguyen
*Assistant Examiner* — John Kirkpatrick
(74) *Attorney, Agent, or Firm* — Yokoi & Co., U.S.A., Inc.; Toshiyuki Yokoi

(57) ABSTRACT

The present invention discloses a liquid crystal display apparatus and a liquid crystal television which are provided with a backlight to be lighted up by a separately-excited inverter circuit and realize improvement of contrast in low brightness. A microcomputer 50 obtains a brightness average value of image data from a brightness average value detecting circuit 22, directs an inverter circuit 62 to oscillate at a duty factor corresponding to the obtained brightness average value, and directs an output processing circuit 33 to perform gamma correction processing with gamma correction data corresponding to the obtained brightness average value. When the brightness average value is lowered, the microcomputer 50 lowers the duty factor to be outputted therefrom and lowers the brightness of the backlight 61. Moreover, when the brightness average value is lowered, the microcomputer 50 directs the output processing circuit to perform gamma correction processing with gamma correction data for widening a brightness range.

1 Claim, 9 Drawing Sheets

FIG.7

| Average luminance | Dimming level |
| --- | --- |
| 10% | 50% |
| 10~30% | 70% |
| ⋮ | ⋮ |

LIQUID CRYSTAL DISPLAY APPARATUS AND LIQUID CRYSTAL TELEVISION, WHICH CAN IMPROVE CONTRAST

CROSS-REFERENCES TO RELATED APPLICATIONS

The present application is related to the Japanese Patent Application No. 2007-129016, filed May 15, 2007, the entire disclosure of which is expressly incorporated by reference herein.

BACKGROUND OF THE INVENTION

1. Field of the Invention

The present invention relates to a liquid crystal display apparatus and a liquid crystal television.

2. Description of the Related Art

In a liquid crystal display apparatus such as a liquid crystal television, performing of gamma correction in such a manner to cause a drive voltage-transmissivity characteristic to become linear is common. However, in such general gamma correction, if the brightness average value level of a video signal is inclined to either a high level or a low level, there is a problem that the variable range of a brightness level becomes narrower and the contrast of a display screen is decreased. It has been known that, in order to solve such a problem, the gamma correction is dynamically performed according to a brightness average level (for example, Japanese Patent Application Laid-Open No. Hei 6-6820).

Further, it has also been known that, as a technology for dynamically performing the gamma correction, gamma correction data is used properly according to atmospheric illumination of the exterior of a display apparatus (for example, Japanese Patent Application Laid-Open No. Hei 11-234539).

Incidentally, in the liquid crystal display apparatus including the liquid crystal television, the transmissivity of backlight is adjusted by controlling the aperture factor of liquid crystal cells, whereby the brightness of respective pixels are determined. Therefore, as well known, even if the aperture factor of the liquid crystal cells is reduced to a minimum, the liquid crystal cells can not perfectly interrupt the transmission of the backlight and can not perform complete black display. Because of such a physical limitation, even if the dynamic gamma correction that has been discussed above is performed, there is a limit to improvement in contrast on the low brightness side (in the vicinity of 0% luminous intensity).

On the other hand, there is also a technology for saving electricity by recognizing a non-displaying region of a liquid crystal panel and controlling the supply of electric power to lamps corresponding to the recognized non-displaying region (for example, Japanese Patent Application Laid-Open No. 2003-66929). That is, this is a technology where, in a region where one lamp takes charge of light-irradiating, when image display is not performed in all of liquid crystal cells in this region, the lamp is caused to be dimmed. However, although this technology is available for a display apparatus in which display is performed so as to create a positive division of lightness and darkness on its screen, it is not suitable for a display apparatus which displays motion pictures such as movie, drama. That is, in such a display apparatus, a continuous image is displayed over the entire screen, so that it is difficult to set the region. If improvement of contrast in an image in which a brightness distribution is inclined is realized by utilizing the technology disclosed in Japanese Patent Application Laid-Open No. 2003-66929, brightness must be monitored at a level at the vicinity of pixels and processing amount becomes enormous.

BRIEF SUMMARY OF THE INVENTION

The present invention aims at providing a liquid crystal display apparatus and a liquid crystal television, provided with a backlight to be lighted up by a separately-excited inverter circuit, that can improve contrast in the low brightness.

The present invention provides a liquid crystal display apparatus, comprising: a backlight, a liquid crystal panel to which light is irradiated from back by the backlight, and an output processing circuit for producing a drive signal from an image data and driving the liquid crystal panel, the liquid crystal display apparatus causes an image based on the image data to be displayed on a screen of the liquid crystal panel, the liquid crystal display apparatus comprises: a brightness average value detecting unit for detecting a brightness average value of the image data; a dimming control unit for adjusting brightness of the backlight by controlling a duty factor (percentage of duty cycle) of a lighting time; a gamma correction unit for performing gamma correction for widening a brightness range when the brightness average value is lower than a predetermined brightness value; and a dimming level setting unit for lowering the duty factor and lowering the brightness of the backlight, when the brightness average value is lower than the predetermined brightness value.

According to the above-mentioned structure, the brightness average value detecting unit detects the brightness average value of the image data, the gamma correction unit which obtains the detected brightness average value causes the image data to be subjected to the gamma correction for widening the brightness range to the brightness average value, and the dimming level setting unit which obtains the detected brightness average value lowers the duty factor in such a manner that the brightness of the backlight is lowered, when the brightness average value is lower than the predetermined brightness value. The dimming control unit, when receive the lowered duty factor, reduces the lighting time of the backlight in each duty according to the duty factor so as to lower the brightness of the backlight.

Therefore, when the average brightness of the screen is lower than the predetermined brightness value, the brightness of the backlight is lowered, whereby the brightness of the image displayed on the liquid crystal panel is entirely shifted to the low brightness side, and the brightness range is widened by the gamma correction, whereby the contrast in the low brightness is improved. That is, power of representation in the low brightness is improved.

Moreover, the gamma correction unit may be designed such that it performs gamma correction for enhancing contrast in a low gradation region and preventing white floating, when the brightness average value is lower than a predetermined value. That is, in the widening of the brightness range, the contrast is enhanced particularly at the low gradation region only, so that the gamma correction which does not affect the brightness of a gradation region except the low gradation region is performed.

Moreover, correspondence data that causes the brightness average value and the duty factor to correspond to each other is provided and the dimming level setting unit may be designed such that it inputs into the dimming control unit the duty factor that is corresponded to the brightness average value by the correspondence data. That is, the correspondence data causing the brightness average value and the duty factor to correspond to each other is previously provided, whereby it is possible to determine the duty factor by only checking the brightness average value with the correspondence data. Therefore, the amount of processing required for determining the duty factor can be decreased.

Moreover, the brightness average value detecting unit may be designed such that it obtains image data corresponding to plural regions previously set on the screen and treats, as the brightness average value, brightness which is obtained by averaging brightness of the obtained image data. That is, the image data of the regions only previously set on the screen is used as a target for calculation of the brightness average value, whereby it is possible to decrease the amount of the processing of calculating the brightness average value.

Moreover, as a concrete embodiment of the present invention, there is provided a liquid crystal television, comprising: a backlight provided with a plurality of cold-cathode tubes; a backlight control unit for controlling a lighting time of the backlight with a duty factor; a liquid crystal panel to which light is irradiated from back by the backlight; a tuner for extracting a video signal from a television broadcast signal and outputting the video signal; a video processing unit for producing image data, which is matched with the pixel number of the liquid crystal panel, from the video signal input from the tuner, causing the image data to be subjected to image quality adjusting processing, and outputting the produced image data; an output processing circuit for performing gamma correction with respect to the image data output from the video processing unit, producing a drive signal from the image data after being subjected to the gamma correction, and driving a plurality of liquid crystal cells forming the liquid crystal panel; and a control unit for directing the duty factor to the backlight control unit and inputting gamma correction data into the output processing circuit; said control unit receives brightness data of video signals from the video processing unit, which correspond to regions that are set at least at three points at an upper portion, three points at a middle portion, and three points at a lower portion of the liquid crystal panel, and calculates brightness average values of the received brightness data for every frame image; when the brightness average values of the frame images are not more than 10%: said control unit causes the duty factor directed to the backlight control unit to be made 50%, lowers brightness of an entire screen, lowers a lower limit of a black level to widen an adjusting range at low gradation, causes the output processing circuit to perform gamma correction with gamma correction data for increasing the black level to enhance contrast at the low gradation, and improves power of representation at the low gradation; when the brightness average values of the frame images are 10-30%, said control unit causes the duty factor directed to the backlight control unit to be 70%, lowers the brightness of the entire screen, lowers an absolute black level to widen the adjusting range at the low gradation, but suppresses lowering of brightness at high gradation as compared with a case where the brightness average value is 10%, causes the output processing circuit to perform gamma correction with gamma correction data for increasing the black level to enhance the contrast at the low gradation, and improves the power of representation at the low gradation.

These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character (s) present corresponding parts throughout:

FIG. 7 shows one example of a dimming level conversion table;

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

For purposes of illustration, programs and other executable program components are illustrated herein as discrete blocks, although it is recognized that such programs and components may reside at various times in different storage components, and are executed by the data processor(s) of the computers.

An embodiment of the present invention will be discussed hereinafter in the following order.

(1) Structure of Liquid Crystal Television:

(2) Structure of Inverter Circuit;

(3) Calculation of Brightness Average Value and Gamma Correction;

(4) Backlight Control Processing and Gamma Correction Processing; and (5) Conclusion.

(1) STRUCTURE OF LIQUID CRYSTAL TELEVISION

Figure 1:
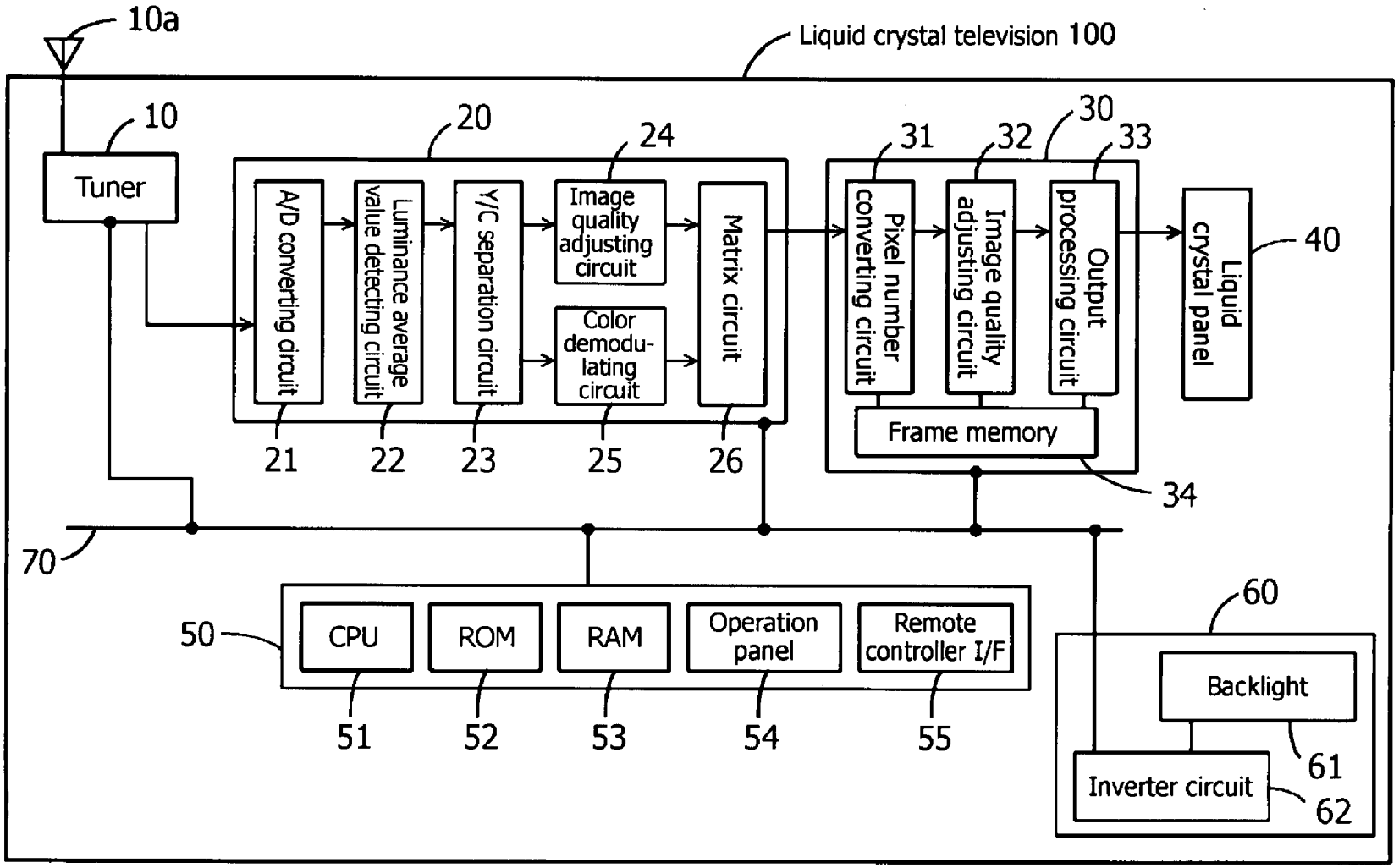
FIG. 1 is a block diagram showing a general structure of a liquid crystal television according to an embodiment of the present invention.

FIG. 1 illustrates a general structure of a liquid crystal television according to an embodiment of the present invention.

As shown in the same Figure, the liquid crystal television 100 generally includes a tuner 10, an RGB signal producing unit 20, a driver circuit 30, a liquid crystal panel 40, a microcomputer 50, and a backlight unit 60. In the structure, the microcomputer 50 is connected via an IIC bus 70 to respective units constituting the liquid crystal television 100, and a CPU 51 controls the whole liquid crystal television 100 according to respective programs written in memories such as ROM 52 and RAM 53. Moreover, an operation panel 54 and a remote controller I/F 55 are connected to the microcomputer 50. According to an input signal produced via the operation panel 54 and an input signal produced by remote control performed via the remote controller I/F 55, the microcomputer 50 can control various processings in the liquid crystal television 100. The microcomputer 50 constitutes a control unit.

The tuner 10 receives a television broadcast signal via an antenna 10*a*, according to the control by the microcomputer 50. Then, the tuner 10 extracts a synthetic video signal, as an intermediate frequency signal, from the television broadcast signal, while performing a predetermined signal-amplification processing, etc., and outputs it to an A/D converting circuit 21 of the RGB signal producing unit 20. Moreover, the tuner 10 separates a synchronized signal from the intermediate frequency signal and supplies it to the respective circuits via the ICC bus. The A/D converting circuit 21 causes the inputted synthetic video signal to be subjected to digital signalize processing according to its signal level. In this embodiment, the RGB signal producing unit 20 is provided with a brightness average value detecting circuit 22. As will be discussed hereinafter, the brightness average value detecting circuit 22 performs processing for calculating the average brightness value of the video signal (average brightness value Ave).

General processing with respect to the synthetic video signal subjected to the digital signalize processing will be discussed hereinafter. First, a Y/C separation circuit 23 performs separation of a brightness signal and a color signal on the basis of the digitized synthetic video signal. The separated brightness signal is inputted into an image quality adjusting circuit 24, subjected to predetermined image-quality processing such as contrast adjusting processing and, thereafter, outputted to a matrix circuit 26. On the other hand, the separated color signal is demodulated into color difference signals R-Y and B-Y in a color demodulating circuit 25 and, thereafter, outputted to the matrix circuit 26. In the matrix circuit 26, matrix converting-processing is performed on the basis of the inputted brightness signal and color difference signals, and an RGB signal is produced as image data.

The produced RGB signal is outputted to the driver circuit 30. The driver circuit 30 includes a pixel number converting circuit 31, an image quality adjusting circuit 32, an output processing circuit 33, and a frame memory 34. The pixel number converting circuit 31 carries out scaling processing with respect to the inputted RGB signal and produces an RGB signal for one screen displayed on the liquid crystal panel 40. Then, the RGB signal for the one screen is stored in the frame memory 34 as pixel information.

The image quality adjusting circuit 32 carries out adjusting of brightness, contrast, black balance and white balance with respect to the RGB signal that is subjected to the scaling processing by the pixel number converting circuit 31 and stored in the frame memory 34. The output processing circuit 33 performs gamma correction processing, dither processing, etc. with respect to the RGB signal subjected to the image quality adjusting processing by the image quality adjusting circuit 32, according to the control by the microcomputer 50, adds a background signal, an OSD signal, a blanking signal, etc. to the RGB signal, outputs it to the liquid crystal panel 40, and causes an image to be displayed. The RGB signal producing unit 20 and the driver circuit 30 except the output processing circuit 33 constitute a video processing unit.

The backlight unit 60 includes a backlight 61 serving as a light source to irradiate the liquid crystal panel 40 from back, and an inverter circuit 62 that converts a direct-current voltage into an alternating-current voltage, then supplies the alternating-current voltage to the backlight 61, and causes the backlight 61 to light up. Moreover, the inverter circuit 62 is connected to the microcomputer 50. The inverter circuit 62 receives a PWM signal serving as a brightness control signal from the microcomputer 50, changes the alternating-current voltage supplied to the backlight 61, on the basis of the PWM signal, and changes brightness. For example, if a duty factor increases, the luminescence brightness of the backlight 61 is increased and, if the duty factor decreases, the luminescence brightness of the backlight 61 is decreased.

(2) STRUCTURE OF INVERTER CIRCUIT

Figure 2:
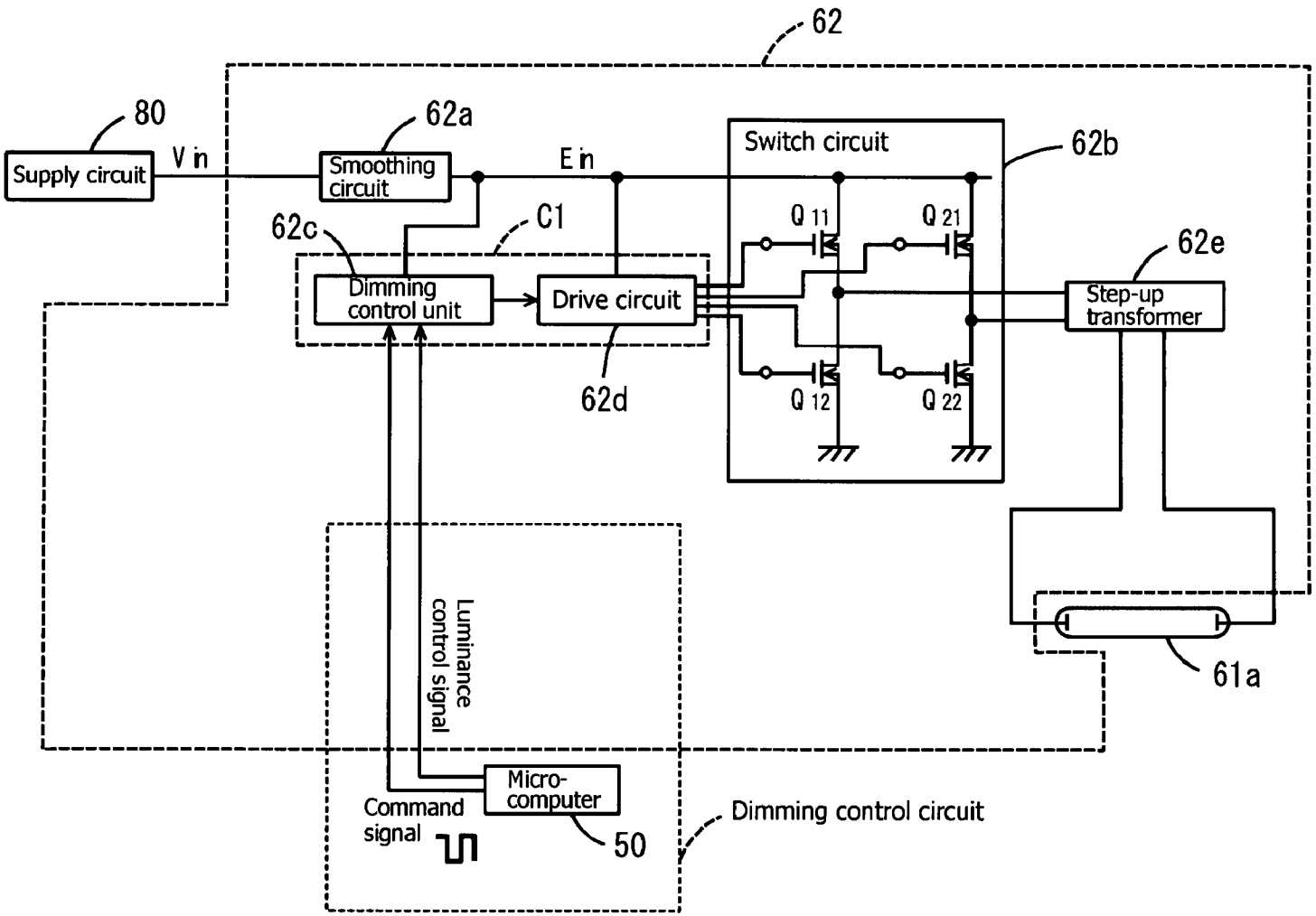
FIG. 2 is a block structure diagram of an inverter circuit.

FIG. 2 is a block structure diagram of the inverter circuit 62 according to this embodiment. As shown in the same Figure, the inverter circuit 62 is a separately excited circuit and generally includes a smoothing circuit 62*a*, a switch circuit 62*b*, a dimming control circuit 62*c*, a drive circuit 62*d*, and a step-up transformer 62*e*. In the structure, the inverter circuit 62 is driven by a direct-current voltage Vin inputted from a supply circuit 80, alternately applies voltages, inverted each other by the switch circuit that is controlled by the control circuit, to the step-up transformer, causes an alternating-current voltage to be produced on the secondary side of the step-up transformer, and causes cold-cathode tubes to light up.

The respective constituents of the inverter circuit 62 will be discussed hereinafter. The switch circuit 62*b* includes, for example, a separately excited converter in which four MOS-FETs Q11, Q12, Q21, Q22 are coupled to form a full-bridge. While the MOS-FETs are employed in the full-bridge circuit in this embodiment, of course, a different transistor device may be employed.

A command signal instructing the turning-on/off of oscillation and a PWM signal indicative of the duty factor of lighting time in PWM control are inputted into the dimming control circuit 62*c* from the microcomputer 50. When the command signal instructing the turning-on of the oscillation and the PWM signal are inputted into the dimming control circuit 62*c*, the dimming control circuit 62*c* oscillates a frequency signal of a required switching frequency according to a duty corresponding to the PWM signal and outputs the frequency signal to the drive circuit 62*d*. That is, the dimming control circuit 62*c* performs the oscillation of the frequency signal in the PWM signal for a duty-on time period and does not perform the oscillation of the frequency signal in the PWM signal for a duty-off time period. For example, when display with maximum brightness is selected in the liquid crystal television 100, the duty is 100% and the dimming control circuit 62*c* always oscillates the frequency signal.

The drive circuit 62*d* controls the MOS-FETs to the frequency signal in such a manner that the MOS-FETs Q11, Q22 are turned on and off at the substantially same timing and the MOS-FETs Q12, Q21 are turned on and off at the substantially same timing. That is, the MOS-FETs Q11, Q12 alternately perform the turning on/off actions and the MOS-FETs Q21, Q22 alternately perform the turning on/off actions. Incidentally, in a case where phase shift control for restraining changes in tube current and tube voltage is performed, the turning on/off timing of the MOS-FETs Q11, Q22 and the turning on/off timing of the MOS-FETs Q12, Q21 may be shifted in the range up to a half-cycle of the switching frequency. The phase shift control means a control in which, in the MOS-FETs that are turned on/off in the full-bridge circuit at the substantially same timing, the on-duty of an alternating current signal inputted into the step-up transformer is increased and decreased by causing a phase of the turning on/off timing to be shifted.

According to the turning on/off actions of the switch circuit 62*b*, voltage that is inverted at a required frequency is applied to the primary winding of the step-up transformer 62*e* and alternating current secondary voltage is produced at the secondary winding of the step-up transformer 62*e*. By this secondary voltage, a cold-cathode tube 61*a* is lighted up. The cold-cathode tube 61*a* constitutes a part of the backlight 61. In FIG. 2, while only the cold-cathode tube 61*a* is illustratively shown, plural cold-cathode tubes are generally provided, and the number of the step-up transformers are also increased or decreased according to the number of the cold-cathode tubes. Of course, the number of switch circuits and feedback circuits are also increased or decreased according to the increase or decrease in the number of the cold-cathode tubes. The switching of the switch circuit 62*b* is controlled by the control circuit which the dimming control circuit 62*c* and the drive circuit 62*d* constitute.

(3) CALCULATION OF LUMINANCE AVERAGE VALUE AND GAMMA CORRECTION

The brightness average value detecting circuit 22 calculates the brightness average value Ave of the video signal processed in the RGM signal producing unit. While the brightness average value may be calculated from a video signal in any stage among video signals processed by the respective circuits of the RGB signal producing unit, a case where the brightness average value is calculated from the synthetic video signal outputted from the A/D converting circuit in this embodiment will be discussed hereinafter.

Figure 3:
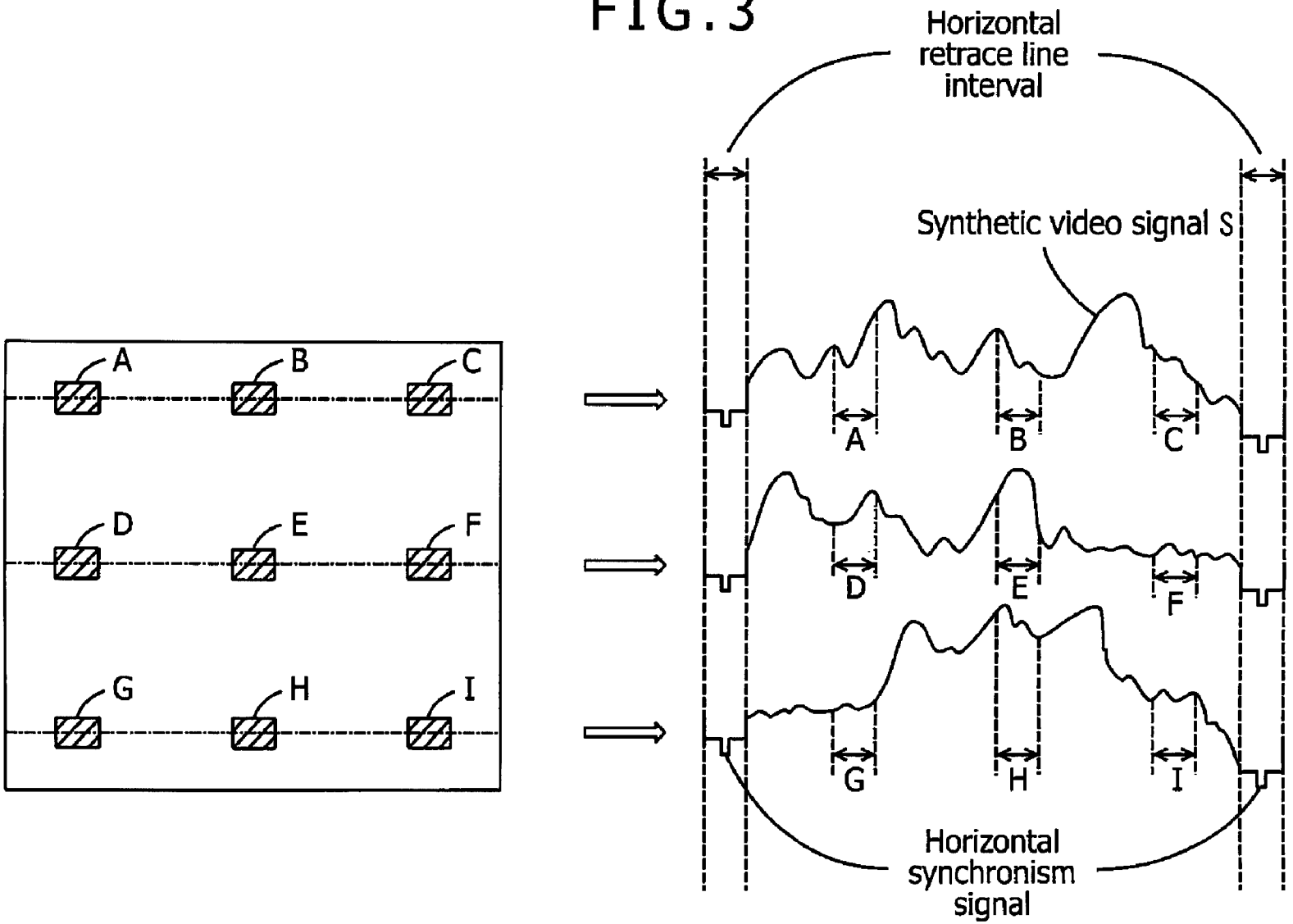
FIG. 3 is a view for explaining one example of the manner of obtaining a brightness data from a synthetic video signal and one example of the manner of calculating a brightness average value.

FIG. 3 is a view for explaining one example of the manner of obtaining brightness data from the synthetic video signal and one example of the manner of calculating the brightness average value. While the synthetic video signal S is represented in the form of an analogue signal in FIG. 3, the synthetic video signal S is converted into a digital signal having gradation corresponding to each signal level by the A/D converting circuit 21 in the actual processing. The brightness average value detecting circuit 22 performs the calculating processing of the brightness average value Ave on the basis of the digitized synthetic video signal S. The brightness average value Ave is calculated for each synthetic video signal for one screen. Incidentally, if an approximate average value is found, it is unnecessary to average total brightness of the synthetic video signals for the one screen. Therefore, in order to achieve a high-speed processing, a region at which the brightness is obtained is set at a required region representative of the screen and the brightness of a synthetic video signal corresponding to the region at which the brightness is obtained can be used for calculating the brightness average value.

As shown in FIG. 3, in this embodiment, regions A-I are set at a substantially center of each screen which is divided into nine, namely, at three points at an upper portion, three points at a middle portion, and at three points at a lower portion, of the substantially center of the screen, and the brightness average value is calculated by averaging brightness obtained from synthetic video signals corresponding to the regions A to I. Of course, as the manner of setting of the regions at which the brightness are obtained, it is possible to employ various manners in which, for example, the screen is equally divided into several areas and the regions at which the brightness are obtained are set at locations corresponding to areas in the vicinity of substantially centers of the respective areas of the divided screen, or set at locations corresponding to a substantially center and four corners of the screen.

Obtaining of the brightness of pixels partially set within one screen is performed as follows. The synthetic video signal S has a horizontal retrace line interval and a horizontal synchronism signal between which a video signal is synthesized. Therefore, if brightness data are obtained at a predetermined timing from respective horizontal scanning lines included in the one screen, brightness data of the synthetic video signals corresponding to the regions A to I are obtained. The brightness average value detecting circuit 22 calculates the brightness average value Ave from the brightness data obtained in this way and outputs it to the microcomputer 50.

In order to achieve high-speed processing, the calculating of the brightness average value may be performed by obtaining brightness from the horizontal scanning lines included in one-time field-scanning, without using all of the scanning lines with respect one-time frame-scanning as processing targets. This is the reason that since the field-scanning lines which are included in the one-time frame-scanning are alternately arranged, it is possible to cause the brightness of the entire screen to be made approximate by even any one of the field-scannings.

Several gamma correction data that correspond to the brightness average value Ave are memorized in the microcomputer 50. On the basis of the gamma correction data memorized in the microcomputer 50, gamma correction for making a drive voltage-transmissivity characteristic linear is basically performed, gamma correction for increasing a white level is performed when the brightness average value is lower than a predetermined value, and gamma correction for increasing a black level is performed when the brightness average value is higher than the predetermined value. That is, a variable range of the brightness level of the video signal is widened according to the brightness average value and gamma correction for improving contrast is carried out.

(4) BACKLIGHT CONTROL PROCESSING AND GAMMA CORRECTION PROCESSING

Figure 4:
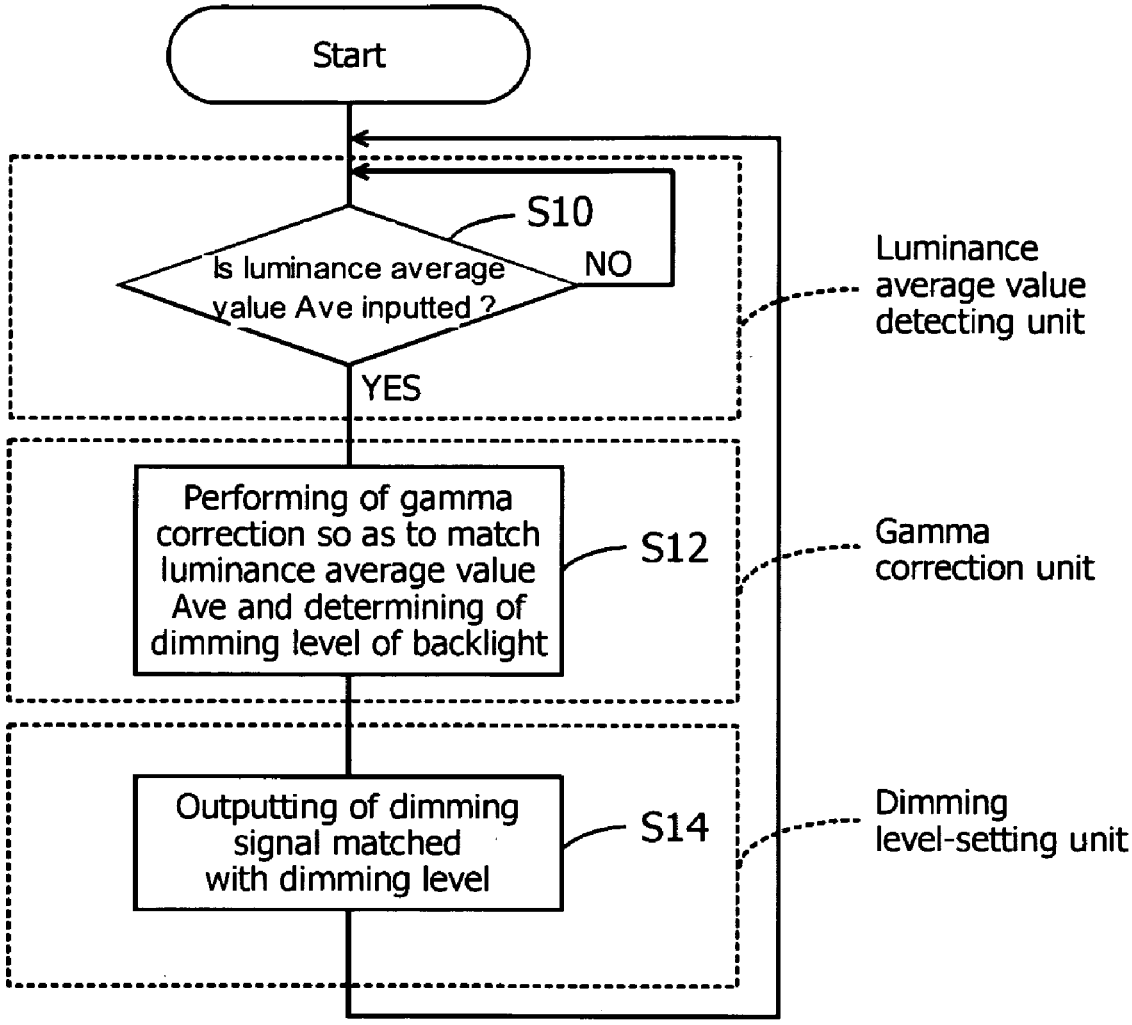
FIG. 4 is a flow chart for backlight control processing and gamma correction processing which are performed by a microcomputer.

FIG. 4 is a flow chart for backlight control processing and gamma correction processing which the microcomputer 50 performs. The gamma correction processing means a processing for dynamically changing the gamma correction on the basis of the inputted brightness average value. The backlight control processing means a processing for dynamically performing the dimming control of the backlight. These processings are performed, for example, in a case where configuration of "contrast improvement", etc. becomes effective. The processing by the microcomputer 50 into which the brightness average value is inputted will be discussed hereinafter.

When the processing is commenced, it is judged in step S10 whether or not the brightness average value is inputted into the microcomputer. That is, if the brightness average value has been inputted into the microcomputer, it is judged that requirements shall be met, and the processing proceeds to step S12. Unless the brightness average value is inputted into the microcomputer, the step S10 is repeated until the brightness average value is inputted into the microcomputer. Since the brightness average value is outputted for each frame image, it is also possible to periodically obtain the brightness average value every time a display time per one frame image lapses. Moreover, taking into it consideration that the change degrees of images between continuous frame images are low and the brightness average value levels become equivalent, the brightness average values may be obtained every several frames. If the timing of obtaining the brightness average values is optimized in this way, processing amount of the microcomputer 50 can be reduced.

In the step S12, the output processing circuit 33 is caused to perform the gamma correction corresponding to the brightness average value. That is, the gamma correction data corresponding to the brightness average value inputted in the step S10 is read out from the ROM 52 and then memorized in a storage medium for memorizing the gamma correction data. γ-conversion table that previously causes the gamma correction data and the brightness average value to correspond to each other is memorized in the ROM 52. The memorizing of the gamma correction data in the storage medium is performed so as to match the timing at which the video signal from which the brightness average value is calculated is processed by the output processing circuit 33. This timing can be matched by utilizing the synchronous signal outputted from the tuner. As the storage medium in which the gamma correction data is memorized, there may be employed various storage mediums, and an exclusive memory which is accessible from the output processing circuit 33 may be provided, and a predetermined region of the frame memory may be used.

The output processing circuit 33 obtains the gamma correction data memorized in the storage medium and reads the video signal out from the frame memory. Then, the output processing circuit 33 performs the gamma correction with respect to the read-out video signal, with the obtained gamma correction data, produces a drive signal from the video signal subjected to the gamma correction processing, and drives the respective liquid crystal cells of the liquid crystal television.

Figure 5:
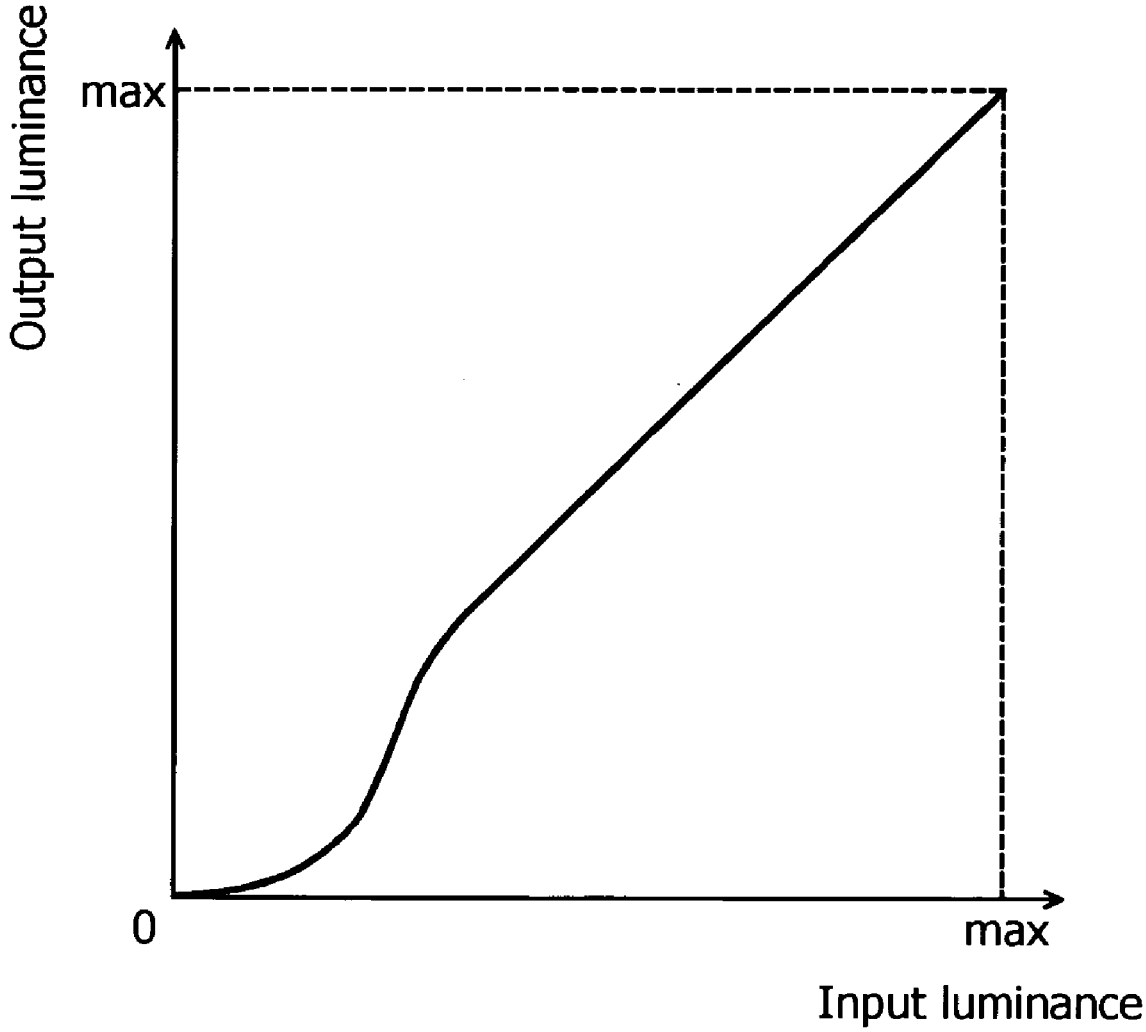
FIG. 5 is a view for explaining gamma correction for increasing a black level.
Figure 6:
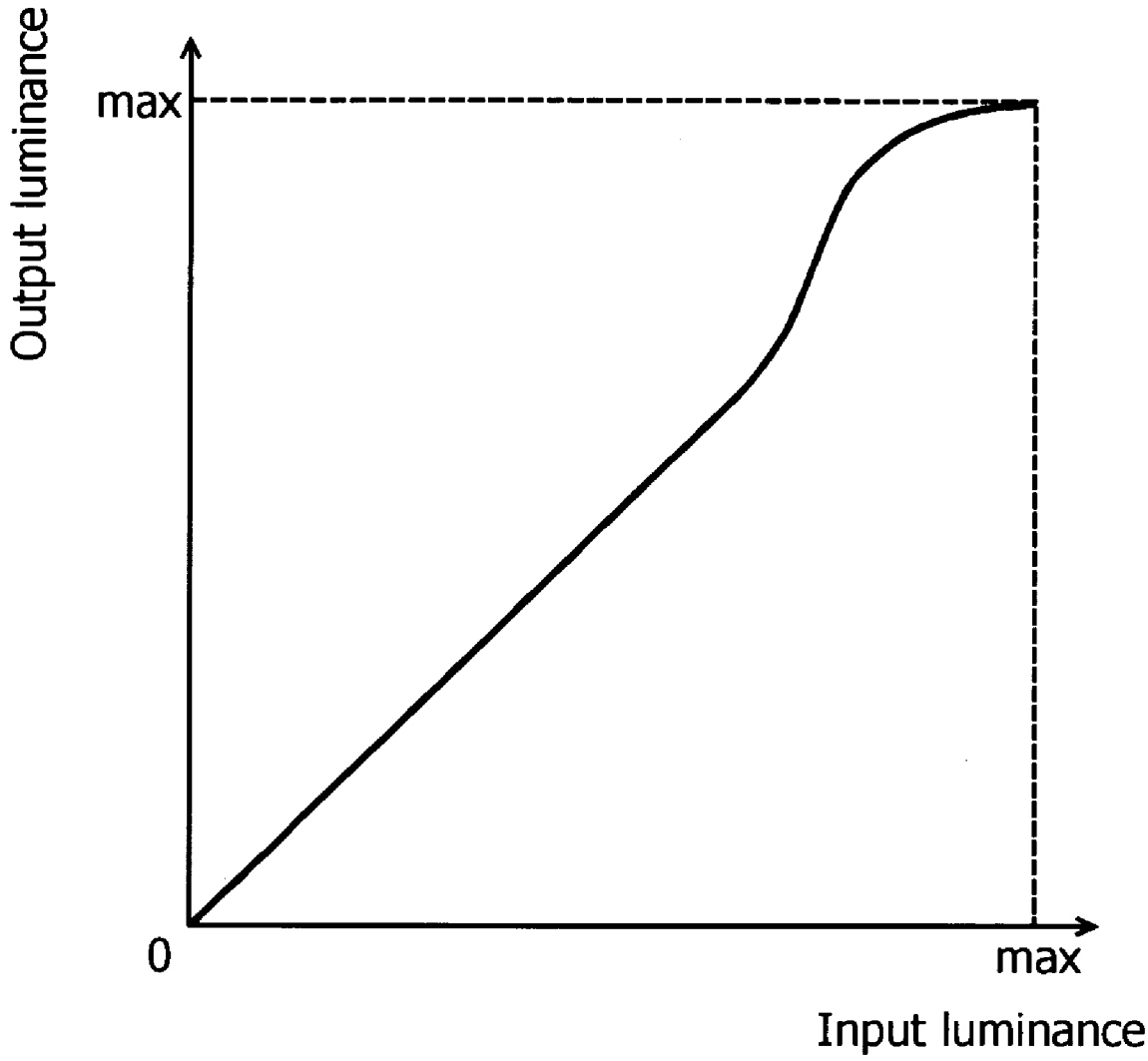
FIG. 6 is a view for explaining gamma correction for increasing a white level.

FIG. 5 is a view for explaining gamma correction for increasing a black level and FIG. 6 is a view for explaining gamma correction for increasing a white level. The gamma correction data memorized in the storage medium in the step S12 is selected as follows. With respect to an image data in which an entire image is dark and a brightness average value is low, as shown in FIG. 5, the gamma correction for increasing the black level is performed to thereby increase contrast with low gradation. On the other hand, with respect to image data in which an entire image is light and a brightness average value is high, as shown in FIG. 6, the gamma correction for increasing the white level is performed to thereby increase contrast with high gradation. By performing such an increase in the white and black levels, contrast in a brightness region in which a brightness distribution ratio is high in the image data is enhanced and the image becomes brilliant.

Moreover, in the step S112, a dimming level of the backlight is also determined on the basis of the brightness average value. That is, in the step S12, a dimming level that corresponds to the brightness average value inputted in the step S10 is read out from the ROM 52. In the ROM 52, a dimming level conversion table that causes the brightness average value and a dimming level to correspond to each other is previously memorized. This dimming level conversion table is prepared in such a manner that the lower the brightness average value is, the lower the dimming level becomes.

FIG. 7 shows one example of the dimming level conversion table. As shown in the same Figure, when the brightness average value is 10%, the dimming level is determined so as to become 50%, namely, the duty factor of the PWM signal inputted as the brightness control signal is determined so as to become 50%. Moreover, when the brightness average value is 10-30%, the dimming level is determined so as to become 70%, namely, the duty factor of the PWM signal is determined so as to become 70%. When the memorizing of the gamma correction data and the determining of the dimming level, have been finished, the processing proceeds to step S14.

In the step S14, a dimming control signal which corresponds to the dimming level determined in the step S112 is produced and outputted to the dimming control circuit 62*c*. Then, the dimming control circuit 62*c* performs switching control in such a manner to match the dimming level.

Figure 8:
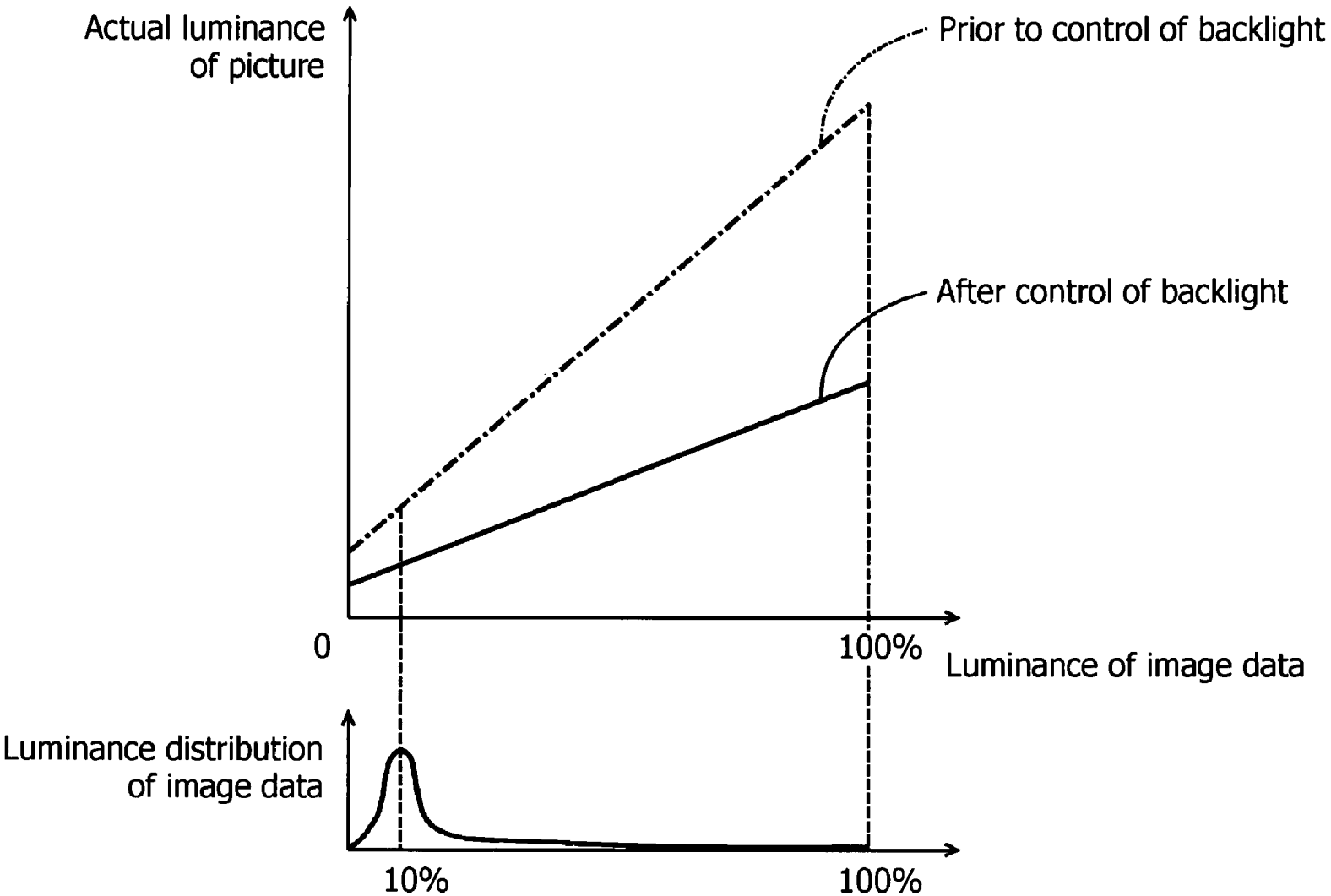
FIG. 8 is a view for explaining brightness at the time that a PWM (pulse width modulation) signal whose duty factor is 50% is inputted.

FIG. 8 is a view for explaining the brightness at the time that the PWM signal whose duty factor is 50% is inputted. For example, when a video signal whose brightness is fully low is displayed on the screen as it is, white floating becomes remarkable due to the leaking light from the backlight, but if the duty factor of the PWM signal is made 50%, the brightness of the entire image is reduced to about 50% as shown in FIG. 8 and a dark region is displayed more darkly (black). That is, the backlight itself is made dark, so that the leaking light is reduced, the white floating is suppressed, and power of representation of low brightness (black) is enhanced. Of course, the image data and the brightness on the high brightness side are also reduced at the same time, but the brightness of the image data is inclined to the vicinity of 10%, so that even if the brightness in the image data on the high brightness side is decreased, the entire image is not practically influenced.

Figure 9:
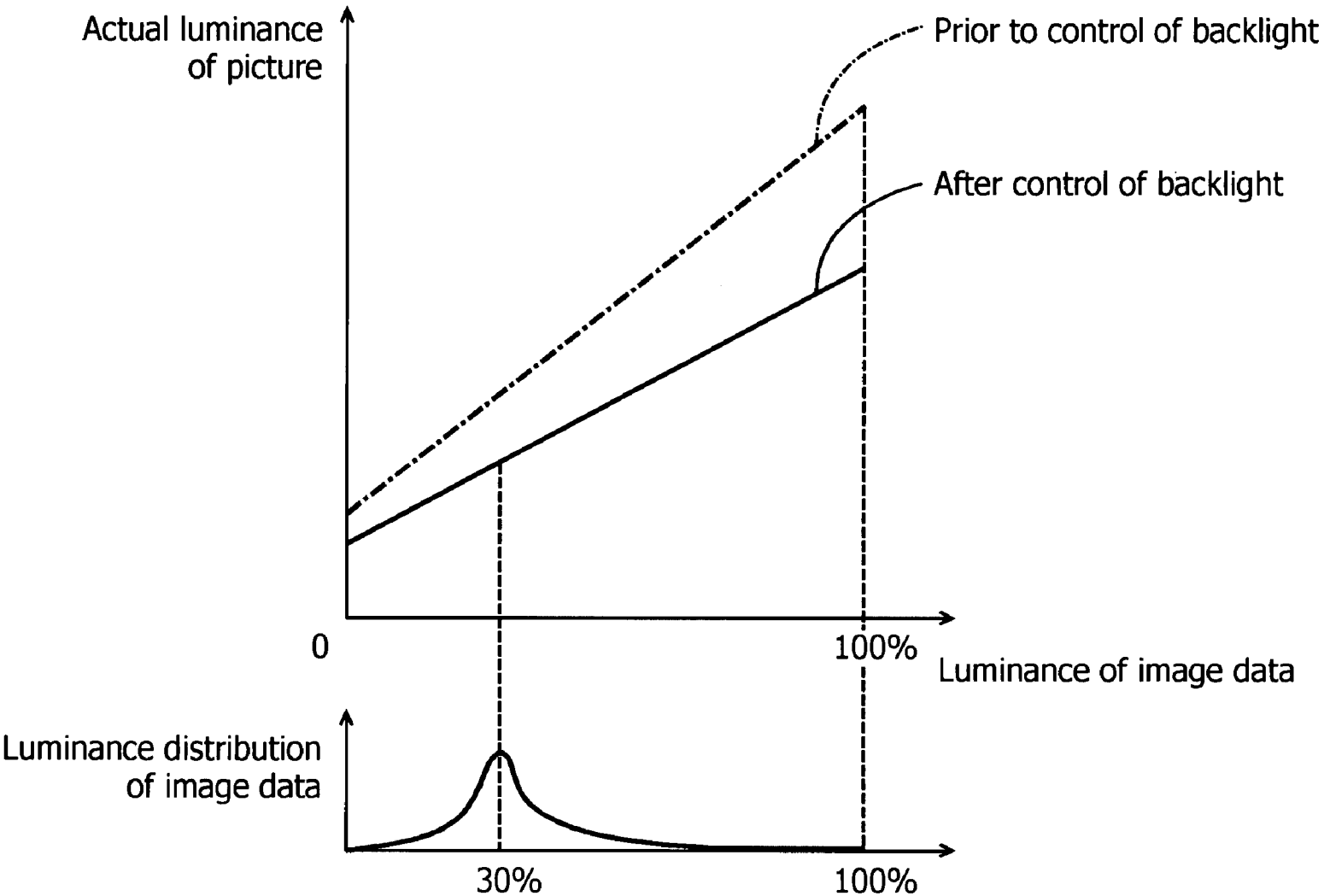
FIG. 9 is a view for explaining brightness at the time that a PWM signal whose duty factor is 70% is inputted.

FIG. 9 is a view for explaining the brightness at the time that a PWM signal whose duty factor is 70% is inputted. When the PWM signal whose duty factor is 70% is inputted, the brightness of the entire image is lowered to about 70% and the dark region is displayed more darkly as in the case where the brightness average value is 10%. Of course, as compared to the case where the brightness average value is 10%, influence by the lowering of the duty factor is reduced. However, as compared to the case where the brightness average value is 10%, the entire screen is light, so that the white floating is hardly remarkable. Therefore, the dimming in which a balance between repeatability of the black level (low gradation region) and repeatability from intermediate gradation to high gradation is offered is performed. When the step S14 has been finished, the processing is returned to the step S10 and the processing waits for input of next brightness average value.

The microcomputer 50 into which the brightness average value outputted from the brightness average value detecting circuit 22 is inputted in the step S10 constitutes a brightness average value detecting unit which detects the brightness average value of the image data, the microcomputer 50 which obtains the gamma correction data, which is caused to be matched with the brightness average value in the step 12S, and causes it to be memorized in the storage medium constitutes a gamma correction unit, and the microcomputer 50 which performs the decreasing of the duty factor of the PWM signal inputted into the inverter circuit 62, in such a manner to match the decreasing of the brightness average value in the step S14 constitutes a dimming level setting unit. Moreover, the microcomputer 50 which outputs the PWM signal, as the brightness control signal, to the inverter circuit 62, in addition to performing of the backlight control processing according to the present invention constitutes a dimming control unit. Further, the inverter circuit 62 which controls the oscillation with the duty factor of the PWM signal inputted from the microcomputer 50 and controls the lighting-up of the backlight constitutes a backlight control unit. Moreover, the dimming level conversion table corresponds to correspondence data.

The operation of the embodiment constructed as discussed above will be discussed hereinafter.

When a user makes the configuration of the "contrast improvement" effective by operating the remote controller, the microcomputer 50 starts the backlight control processing and the gamma correction processing. First, the microcomputer 50 obtains the brightness average value per one frame from the brightness average value detecting circuit. Next, the microcomputer 50 obtains a γ-correction value and a dimming level, which correspond to the brightness average value, with reference to the γ-conversion table and the dimming level conversion table of the ROM 52. Then, the microcomputer 50 produces a PWM signal corresponding to the obtained dimming level, outputs it to the inverter circuit, and causes the obtained gamma correction data to be memorized in the storage medium.

As a result, for example, if the brightness average value is 10%, the duty factor of the PWM signal inputted into the inverter circuit 62 becomes 50% and the switch circuit performs the switching operating by 50% of one cycle of the PWM signal. Therefore, the brightness of the entire screen is lowered and a black level of an image displayed is lowered. Thus, it is possible to extend an adjusting range to the low brightness side.

Moreover, when the brightness average value is not more than 10%, the gamma correction data for increasing the black level is memorized in the storage medium. That is, a contrast in brightness in the vicinity of 0% luminous intensity is enhanced and power of representation in the vicinity of the brightness average value is improved. The increasing of the black level is performed to thereby make use of the black level whose adjusting range is widened by the control of the dimming level, thus making it possible to more finely perform representation of gradation of the brightness at the low gradation.

On the other hand, when the brightness average value is 10-30%, the duty factor of the PWM signal inputted into the inverter circuit becomes 70% and the switch circuit performs the switching control by 70% of the one cycle of the PWM signal. Therefore, the brightness of the entire screen is lowered to a level that is not the level as in the case where the brightness average value is 10%, and the black level of the image displayed is lowered. Thus, lowering of the intermediate and high brightness are suppressed by suppressing the brightness of the entire screen while lowering the black level of the image displayed with the brightness of the entire screen being lowered. Therefore, the dimming control in which a balance between extension of the adjusting range to the lower brightness and the suppression of the lowering of the intermediate and high brightness is offered is performed.

Moreover, when the brightness average value is 10-30%, the gamma correction data for increasing the black level is memorized in the storage medium in the same manner as in the case where the brightness average value is 10%. That is, when the brightness average value is 10-30%, the increasing of the black level is also performed, to thereby make use of the black level whose adjusting range is widened by the control of the dimming level, thus making it possible to more finely perform representation of gradation of the brightness at the low gradation.

(5) CONCLUSION

As discussed above, the microcomputer 50 obtains the brightness average value of the image data from the brightness average value detecting circuit 22, directs the inverter circuit 62 to oscillate at the duty factor corresponding to the obtained brightness average value, and directs the output processing circuit 33 to perform the gamma correction processing with the gamma correction data corresponding to the obtained brightness average value. When the brightness average value is lowered, the microcomputer 50 lowers the duty factor to be outputted therefrom and lowers the brightness of the backlight 61. Moreover, when the brightness average value is lowered, the microcomputer 50 directs the output processing circuit to perform the gamma correction processing with the gamma correction data for widening the brightness range. By the processing performed by the microcomputer 50 in this way, in the liquid crystal display apparatus and the liquid crystal television which are provided with the backlight that is lighted up by the separately-excited inverter circuit, improvement of the contrast with the low brightness is realized.

Incidentally, in the present invention, the following modifications are possible.

The brightness average value detecting circuit 22 may be designed such that, for example, it designates a predetermined position of the matrix from the video signal matrixed in the matrix circuit to thereby obtain a gradation value of the video signal as a brightness data, and calculates the brightness average value utilizing this brightness data. Moreover, the brightness average value detecting circuit 22 may be designed such that it obtains a data corresponding to a pixel at a predetermined position from the image data memorized in the frame memory of the driver circuit, that is, the image data after being subjected to the scaling processing, and calculates the brightness average value.

While the gamma correction processing and the backlight control processing are performed at the same time in the above-mentioned embodiment, of course these processings may be performed separately.

In the above-mentioned embodiment, when the brightness average value is low, the brightness of the backlight is lowered and the repeatability of the black level is enhanced. However, there is a possibility that even if the brightness average value is low, a bright part that is partially high-luminous is present. To cope with such a possibility, if it is necessary to lower the lightness of the backlight and prevent the white floating, gamma correction may be performed in such a manner to previously compensate for the lowering of the brightness of the backlight.

For example, when the backlight is dimmed to 50% brightness, the brightness of the entire screen reduces by half. Therefore, gamma correction is performed in such a manner that the aperture factor of the cells (transmissivity characteristic) relative to each brightness becomes twice as large as the normal. By this, an image data whose brightness is not more than 50% is displayed with correct brightness, without spoiling the repeatability of the black level. Of course, an image data whose brightness is more than 50% is saturated in the aperture factor of the cells, so that the entire image data is displayed with the same brightness but the repeatability of a main part of the brightness distribution is sufficiently ensured.

Incidentally, it should go without saying that the present invention is not limited to the above-mentioned embodiments. It will be understood by those skilled in the art that, regarding the above-mentioned elements and constructions which are changeable with each other, their combinations may be suitably changed, that the conventional elements and constrictions that have been described above may be suitably replaced by any elements and constructions which are not described above and are changeable with the conventional elements and constrictions, and that the above-mentioned elements and constructions may be suitably replaced by any elements and constructions which are not described above and are considered to be substituted for the above-mentioned elements and constructions on the basis of the prior art.

While the invention has been particularly shown and described with respect to preferred embodiments thereof, it should be understood by those skilled in the art that the foregoing and other changes in form and detail may be made therein without departing from the spirit and scope of the invention as defined in the appended claims.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, proximal, distal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

What is claimed is:

1. A liquid crystal television, comprising:

a backlight provided with a plurality of cold-cathode tubes;

a backlight control unit for controlling a lighting time of the backlight with a duty factor;

a liquid crystal panel to which light is irradiated from back by the backlight;

a tuner for extracting a video signal from a television broadcast signal and outputting the video signal;

a video processing unit for producing image data, which is matched with a pixel number of the liquid crystal panel, from the video signal input from the tuner, causing the image data to be subjected to image quality adjusting processing, and outputting the produced image data;

an output processing circuit for performing gamma correction with respect to the image data output from the video processing unit, producing a drive signal from the image data after being subjected to the gamma correction, and driving a plurality of liquid crystal cells forming the liquid crystal panel; and a control unit for directing the duty factor to the backlight control unit and inputting gamma correction data into the output processing circuit;

said control unit receives brightness data of video signals from the video processing unit, which correspond to regions that are set at least at three points at an upper portion, three points at a middle portion, and three points at a lower portion of the liquid crystal panel, and calculates brightness average values of the received brightness data for every frame image;

when the brightness average values of the frame images are not more than 10%:

said control unit causes the duty factor directed to the backlight control unit to be made 50% of a PWM signal (pulse width modulation), lowers brightness of an entire screen, lowers a lower limit of a black level to widen an adjusting range at low gradation, causes the output processing circuit to perform gamma correction with gamma correction data for increasing the black level to enhance contrast at the low gradation, and improves power of representation at the low gradation;

when the brightness average values of the frame images are 10-30%, said control unit causes the duty factor directed to the backlight control unit to be 70% of the PWM signal, lowers the brightness of the entire screen, lowers a black level to widen the adjusting range at the low gradation, but suppresses lowering of brightness at high gradation as compared with a case where the brightness average value is 10%, causes the output processing circuit to perform gamma correction with gamma correction data for increasing the black level to enhance the contrast at the low gradation, and improves the power of representation at the low gradation.

* * * * *